US010139762B2

(12) United States Patent
Katada

(10) Patent No.: US 10,139,762 B2
(45) Date of Patent: Nov. 27, 2018

(54) IMAGE FORMING APPARATUS FOR PRINTING A FIRST IMAGE AND FOR PRINTING A SECOND IMAGE WHERE INFORMATION SATISFIES A PREDETERMINATION CONDITION

(71) Applicant: Konica Minolta, Inc., Chiyoda-ku, Tokyo (JP)

(72) Inventor: Kazunori Katada, Hino (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/867,994

(22) Filed: Jan. 11, 2018

(65) Prior Publication Data

US 2018/0224784 A1 Aug. 9, 2018

(30) Foreign Application Priority Data

Feb. 7, 2017 (JP) ..... 2017-020687

(51) Int. Cl.
*G03G 15/00* (2006.01)

(52) U.S. Cl.
CPC ..... *G03G 15/50* (2013.01); *G03G 15/5016* (2013.01)

(58) Field of Classification Search
CPC ..... G03G 15/50; G03G 15/5016; G03G 2215/00455; G03G 2215/00459; G03G 15/0844; G03G 15/6517
See application file for complete search history.

(56) References Cited

U.S. PATENT DOCUMENTS

2015/0071671 A1 3/2015 Kiuchi et al.
2016/0170358 A1* 6/2016 Fukai ..... G03G 15/556 399/27
2016/0291517 A1* 10/2016 Kamei ..... G03G 15/556

FOREIGN PATENT DOCUMENTS

JP 5741656 B2 7/2015

* cited by examiner

*Primary Examiner* — Sandra Brase
(74) *Attorney, Agent, or Firm* — Buchanan Ingersoll & Rooney PC

(57) ABSTRACT

An image forming apparatus includes: an image former that develops, with toner, an electrostatic latent image formed on an image carrier on the basis of a job and prints a first image on continuous paper and; a hardware processor that controls the image former to print a second image on continuous paper in a case where at least either image information or continuous printing distance information of the first image formed by the image former satisfies a predetermined condition, wherein the hardware processor notifies a user of print information indicating a print position of the second image formed by the image former.

11 Claims, 7 Drawing Sheets

FIG. 8

| | | NUMBER OF PRINT COPIES | |
|---|---|---|---|
| | | ONE COPY | MORE THAN ONE COPY |
| CONTINUOUS PRINTING DISTANCE | 0 TO 5 M | ○ | — |
| | 5 TO 300 M | — | — |
| | 300 M OR MORE | ◎ | ◎ |

IMAGE FORMING APPARATUS FOR PRINTING A FIRST IMAGE AND FOR PRINTING A SECOND IMAGE WHERE INFORMATION SATISFIES A PREDETERMINATION CONDITION

The entire disclosure of Japanese patent Application No. 2017-020687, filed on Feb. 7, 2017, is incorporated herein by reference in its entirety.

BACKGROUND

Technological Field

The present invention relates to an image forming apparatus for printing an image on continuous paper.

Description of the Related art

Conventionally, image forming apparatuses such as printers and copying machines adopting an electrophotographic method have been used widely. In image forming apparatuses, generally, an image forming process is performed through a series of processes that an electrostatic latent image is written by irradiating a photosensitive drum having a uniformly electrified surface with laser light by an optical device, the electrostatic latent image is developed with toner in a developing device, the developed toner image is transferred to paper via an intermediate transfer belt, and then the transferred toner image is fixed on the sheet.

Herein, it is known that the toner deteriorates, for example, in a case where the toner is not consumed for a long time. There is a problem that when the toner deteriorates, an electrified amount of the toner decreases, and image quality declines. As a countermeasure against this problem, a deteriorated toner discharging process that forcibly discharges the deteriorated toner staying in the developing device to the outside has been performed conventionally. For example, in a case where an image is formed on each paper sheet (flat paper), a belt-shaped pattern or the like is formed on an intermediate transfer belt at a timing at which the image is not formed between paper sheets. In this way, the deteriorated toner is discharged.

However, for example, in a case where image is formed on long continuous paper such as roll paper, there is no area only to form a belt-shaped pattern or the like between images. Therefore, it is difficult to discharge the deteriorated toner. Therefore, JP 5741656 B2 describes an image forming apparatus with which a predetermined image pattern is formed in a side area of continuous paper outside an image area so that an area coverage becomes equal to or larger than a predetermined, threshold, thereby promoting the circulation of the toner and suppressing the deterioration of the toner.

However, the image thrilling apparatus described, in JP 5741656 132 has the following problem. That is, in the conventional image forming apparatus, when a continuous printing distance and an image coverage reach certain conditions, an image pattern for discharging deteriorated toner is controlled to be printed on roll paper. Therefore, there is a problem that an image pattern that is not an image based on a job is suddenly printed on the roll paper, and a user cannot confirm in advance that the print position or the like of the pattern for discharging the deteriorated toner.

SUMMARY

The present invention has been made in view of the above problem. It is therefore an object of the present invention to provide an image forming apparatus allowing a user to confirm in advance a print position of a pattern for discharging deteriorated toner.

To achieve the abovementioned object, according to an aspect of the present invention, an image forming apparatus reflecting one aspect of the present invention comprises: an image former that develops, with toner, an electrostatic latent image formed on an image carrier on the basis of a job and prints a first image on continuous paper and; a hardware processor that controls the image former to print a second image on continuous paper in a case where at least either image information or continuous printing distance information of the first image formed by the image former satisfies a predetermined condition, wherein the hardware processor notifies a user of print information indicating a print position of the second image formed by the image former.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 7 is a flowchart illustrating an exemplary operation of the image forming apparatus in the case of executing a print confirmation mode or the like; and FIG. 8 is a diagram illustrating relationship between a continuous printing distance, the number of print copies, and the presence or absence of printing of an image for notifying the print position or the like of the image pattern for discharging the deteriorated toner.

DETAILED DESCRIPTION OF EMBODIMENTS

Hereinafter, one or more preferred embodiments of time present invention will be described in detail with reference to time drawings. However, the scope of the invention is not limited to the disclosed embodiments. Furthermore, time dimensional ratios of the drawings are exaggerated for convenience of description and may differ from actual ratios.

Exemplary Configuration of Image Forming System 100

Figure 1:
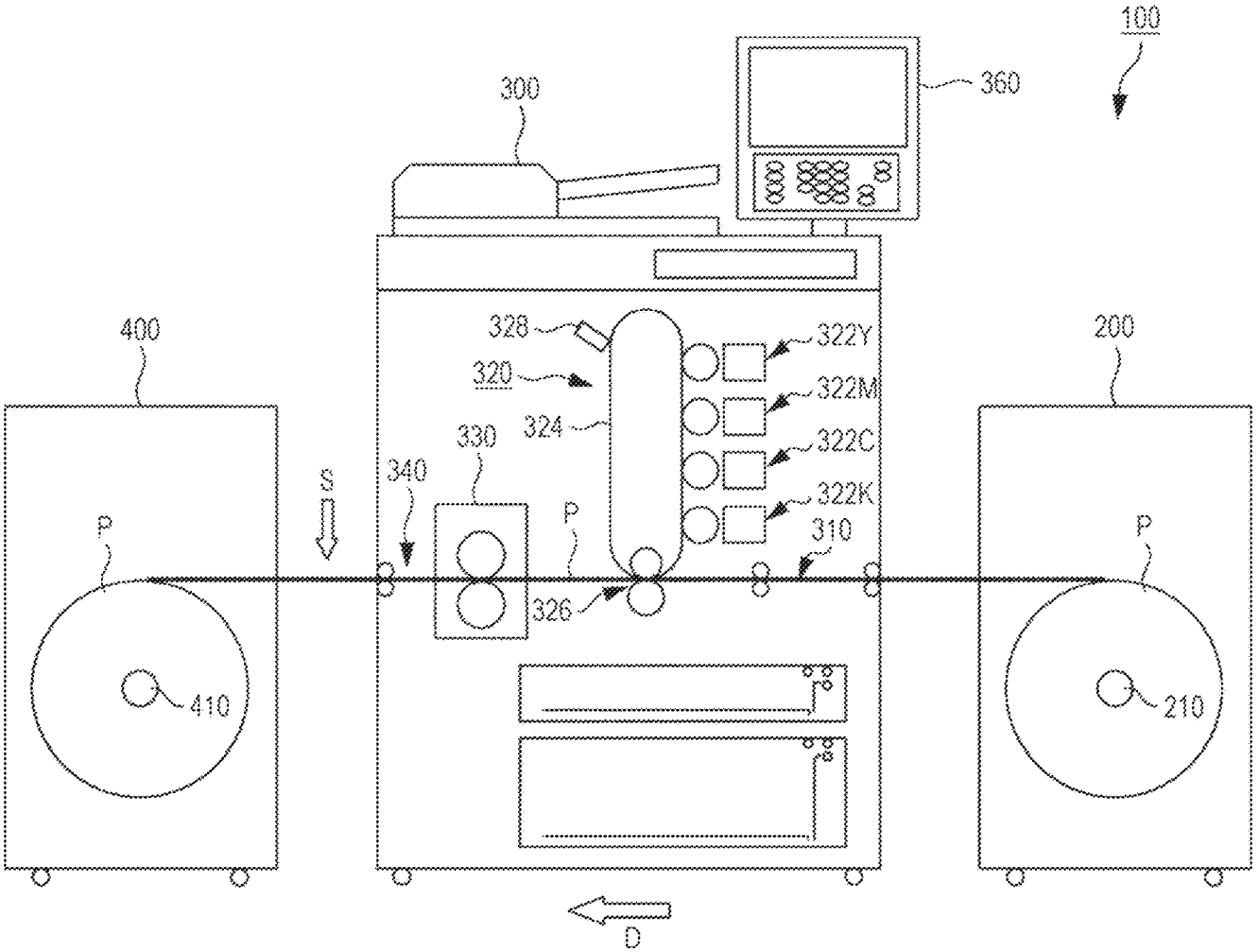
FIG. 1 is a diagram illustrating an exemplary configuration of an image forming system according to an embodiment of the present invention.

FIG. 1 illustrates an exemplary schematic configuration of an image forming system 100 according to an embodiment of the present invention. As illustrated in FIG. 1, the image forming system 100 forms an image on continuous paper such as roll paper P and the like, and includes a paper feeding device 200, an image forming apparatus 300, and a paper discharging device 400.

The paper feeding device 200 is disposed on an upstream side of the image forming apparatus 300 in a paper conveying direction D and includes a mounting unit 210 including a support shaft. The mounting unit 210 rotatably supports the wound roll paper P, and sends out the roll paper P to the image forming apparatus 300 on the basis of a job start instruction. The roll paper P is, for example, paper on which a label is printable, and includes a base sheet and a printing surface pasted via a sealing member. Note that continuous paper is not necessarily held in a roll form and may be folded. Furthermore, a plurality of sheets of long continuous paper may be used.

The image forming apparatus 300 is a tandem type color electrophotographic copying machine and includes a fed-paper conveying unit 310, an image former 320, a fixing unit 330, a discharged-paper conveying unit 340, and an operation display 360.

The fed-paper conveying unit 310 includes, for example, a plurality of conveying rollers, a driving motor that rotationally drives the conveying rollers. The fed-paper conveying unit 310 rotates the plurality of conveying rollers by driving the driving motor, thereby conveying the roll paper P fed from the paper feeding device 200 to the image former 320.

The image former 320 includes a yellow image former 322Y, a magenta image former 322M, a cyan image former 322C, a black image former 322K, an intermediate transfer belt 324, a secondary transfer unit 326. Note that the image formers 322Y, 322M, 322C, and 322K of the respective colors include an electrification unit, an exposure unit, a developing unit, a photosensitive drum, and the like. However, since known techniques can be adopted, detailed descriptions will be omitted.

Toner images of the respective colors formed by the image formers 322Y, 322M, 322C, and 322K are superimposed and transferred, onto an image forming position of the intermediate transfer belt 324. In the secondary transfer unit 326, the toner images of the respective colors of the intermediate transfer belt 324 are collectively transferred onto the roll paper P conveyed by the fed-paper conveying unit 310.

The fixing unit 330 includes, for example, a fixing roller, a pressure roller, and a fixing belt. The fixing unit 330 fixes the toner image on the surface of the roll paper P by performing a heating and pressurizing process on the roll paper P on which the toner image has been transferred by the secondary transfer unit 326.

The discharged-paper conveying unit 340 includes, for example, a plurality of conveying rollers, a driving motor for rotationally driving the conveying rollers. The discharged-paper conveying unit 340 rotates a plurality of conveying rollers by driving the driving motor, thereby conveying the roll paper P subjected to a fixing process by the fixing unit 330 to the paper discharging device 400 in a subsequent stage.

The operation display 360 includes a touch panel in which a display and an input unit are combined, and operation keys including a start key, a decision key, and the like provided in a peripheral portion of the touch panel. The operation display 360 displays an operation screen or the like, and accepts various information such as an image formation condition input by a touch operation on an operation screen or the like and by operating an operation key.

The paper discharging device 400 is disposed on a downstream side of the image forming apparatus 300 in the paper conveying direction D and has a winding unit 410 including a support shaft. The winding unit 410 winds up the roll paper P discharged from the discharged-paper conveying unit 340 of the image forming apparatus 300 around the support shaft. The roll paper P does not necessarily have to be wound in a roll form, and can be housed while being cut for each page.

Note that an adjustment device (buffer) may be provided between the paper feeding device 200 and the image forming apparatus 300 in order to absorb a speed difference between a conveying speed of the roll paper P in the paper feeding device 200 and a conveying speed of the roll paper P in the image forming apparatus 300 and the like. Additionally, a similar adjustment device may be provided between the image forming apparatus 300 and the paper discharging device 400. Additionally, an adjustment mechanism may be attached as a unit to a side face portion in the vicinity of a conveying portion and a discharging portion of the image forming apparatus 300. Furthermore, a processing device that performs processes such as cutting out a label and laminating the roll paper P on which an image is printed may be provided between the image forming apparatus 300 and the paper discharging device 400.

Exemplary Block Configuration of Image Forming Apparatus 300

Figure 2:
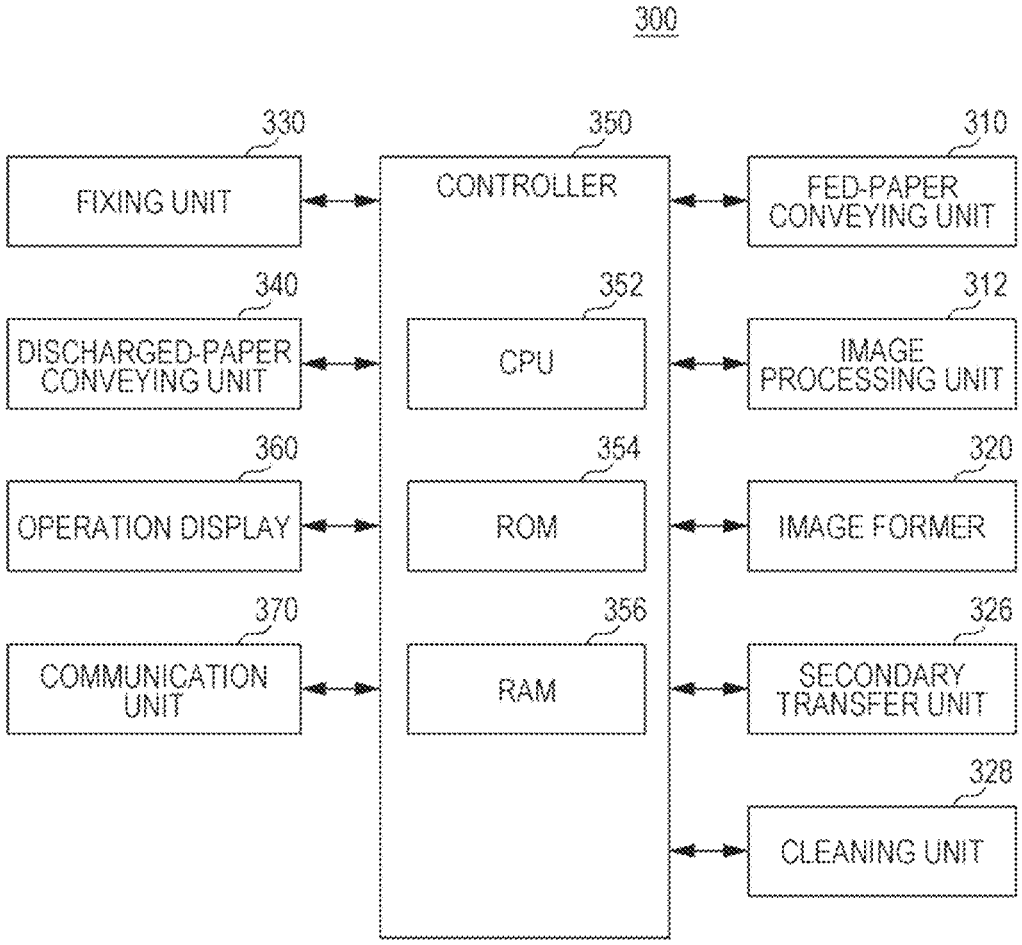
FIG. 2 is a block diagram illustrating an exemplary functional configuration of an image forming apparatus.

FIG. 2 is a block diagram illustrating an exemplary functional configuration of the image forming apparatus 300 in the image forming system 100 according to an embodiment of the present invention. As illustrated in FIG. 2, the image forming apparatus 300 includes a controller 350 for controlling the operation of the entire system. The controller 350 includes a central processing unit (CPU) 352, a read only memory (ROM) 354, and a random access memory (RAM) 356. The CPU 352 expands, to the RAM 356, software (program) read from the ROM 354 and executes the software, thereby controlling each pail of the image forming apparatus 300 to achieve functions related to image formation.

The controller 350 is connected to the fed-paper conveying unit 310, an image processing unit 312, the image former 320, the secondary transfer unit 326, a cleaning unit 328, the fixing unit 330, the discharged-paper conveying unit 340, the operation display 360, and a communication unit 370. The fed-paper conveying unit 310, the image processing unit 312, the image former 320, the secondary transfer unit 326, the fixing unit 330, the discharged-paper conveying unit 340, the operation display 360, and the like execute a predetermined process on the basis of an instruction of the controller 350

The cleaning unit 328 has a plate-like blade, and removes an image pattern for discharging deteriorated toner formed on the intermediate transfer belt 324 while contacting the surf ace of the intermediate transfer belt 324, and toner remaining at the time of image formation.

The communication unit 370 is an interface for communicating with other external device (for example, a host device in which a printer driver is incorporated) via a network such as a local area network (LAN) and a wide area network (WAN). Standards such as Ethernet (registered trademark), Wi-Fi, a fiber distributed data interface (FDDI), and a token ring are used for communication.

The controller 350 executes a print confirmation mode for printing an image pattern G2 for confirming in advance a print position of an image pattern RFP for discharging the deteriorated toner, for example, at the time of test print of a job having a continuous printing distance exceeding 300 m. The print confirmation mode can be selected, for example, by a mode selection button displayed on a screen of the operation display 360.

Figure 3:
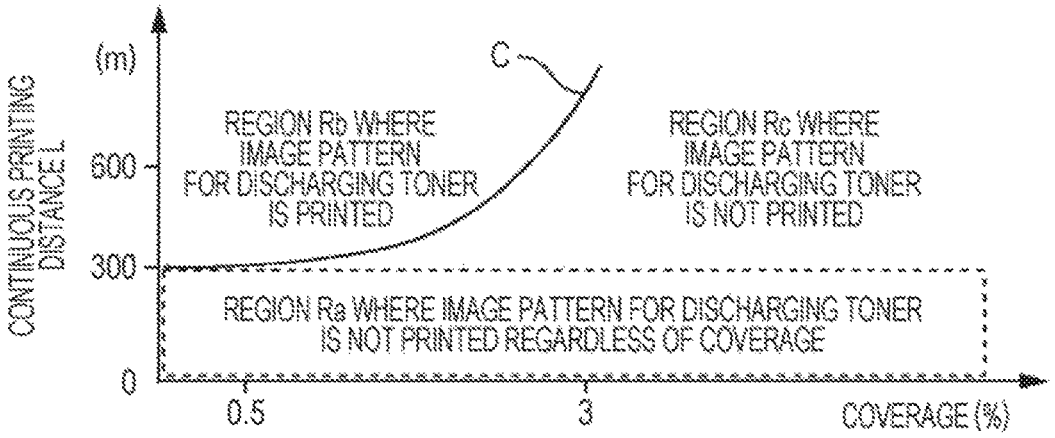
FIG. 3 is a graph for describing a method of selecting a deteriorated toner discharge sequence.

Exemplary Relationship Between Image Coverage, Continuous Printing Distance, and Method of Discharging Deteriorated Toner FIG. 3 is a graph for describing relationship between an image coverage, and a continuous printing distance, and a deteriorated toner discharging method. In FIG. 3, a vertical axis illustrates the continuous printing distance for which an image is continuously printed, and the horizontal axis illustrates the image coverage. Note that an image coverage can be detected by a pixel counter or the like, and can be acquired from exposure information of the job.

As illustrated in FIG. 3, in a case where the continuous printing distance of a job to be executed is 300 m or less (broken line portion), irrespective of the image coverage, the image pattern RFP for discharging the deteriorated toner is continuously printed without being printed on the roll paper P. In the present embodiment, this area is called an area Ra. Note that the continuous printing distance that serves as a reference for whether to print the image pattern RFP on the roll paper P is not limited to 300 m or less. The continuous printing distance can be appropriately changed according to various parameters such as toner characteristics, usage environment, apparatus characteristics.

A continuous printing threshold curve C is a curve defined on the basis of the continuous printing distance and the image coverage, and the presence or absence of discharging of the deteriorated toner is determined on the basis of this curve. More specifically, in a case where the job is in an area on the left side of the continuous priming threshold curve C, the image pattern RFP for discharging the deteriorated toner is printed. In the present embodiment, this area is called an area Rb. In a case where the job is on the right side of the continuous printing threshold curve C and is in an area including the area Ra, the image pattern RFP for discharging the deteriorated toner is not printed. In the present embodiment, this area is called, an area Rc.

In a case where the job having the continuous printing distance exceeding 300 m is executed, since the job is in the area Ra, when tile continuous printing distance is up to 300 m, the image pattern RFP for discharging the deteriorated toner is not printed on the roil paper P. Meanwhile, when the continuous printing distance exceeds 300 m, since the job shifts from the area Ra to the area Rb, the image pattern RFP for discharging the deteriorated toner is suddenly printed on the roil paper P together with the printing of a normal image G1 on the basis of the job.

Therefore, in the present embodiment, in a case where the job having the continuous printing distance exceeding 300 m is executed and for example, the test print of the job is executed, the image pattern G2 for notifying the print position of the image pattern RFP is printed on the roll paper P, and a user is notified in advance of the print position, shape, and the like of the image pattern RFP.

Exemplary Configuration of Image Pattern RFP

Figure 4:
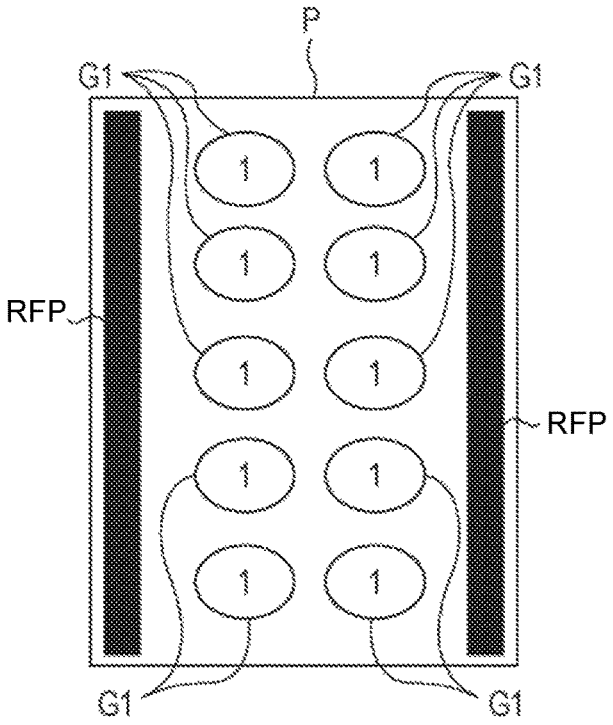
FIG. 4 is a diagram illustrating an exemplary configuration of a normal image and an image pattern for discharging deteriorated toner.

FIG. 4 illustrates an exemplary configuration of the image pattern REP. As illustrated in FIG. 4, in a case where the continuous printing distance and the image coverage satisfy the above-described condition, that is, in a case where the job corresponds to the area Rb in FIG. 3, the normal image G1 based on the job is printed in a substantially central area other than ends in a direction orthogonal to the paper conveying direction D (refer to FIG. 1) on the roll paper P, and the image pattern RFP is printed at each end on the roll paper P that is a position different from the position of the normal image G1.

The image pattern RFP is of a belt-like shape (elongated rectangular shape) when viewed in a plan view. The longitudinal direction of the image pattern RFP extends along the longitudinal direction (extending direction) of the roll paper P. A density of the image pattern RFP can be optionally set. Herein, in a case where the job is in the areas Ra and Rc in FIG. 3, the area where the normal image G1 based on the job to be printed is expanded to an area of the ends on the roll paper P on which the image pattern RFP is to be printed. That is, in the job of the areas Ra and Rc, the area where the image pattern REP to be printed is also used as an area where the normal image G1 is to be printed. In a case where the job is in the area Rb in FIG. 3, the area where the normal image G1 based on the job to be printed is reduced to an area excluding the ends of the roil paper P.

Exemplary Notification in Case of Noticing User of Print Position of Image Pattern RFP

Exemplary Configuration of Image Pattern G2*a*

Figure 5A:
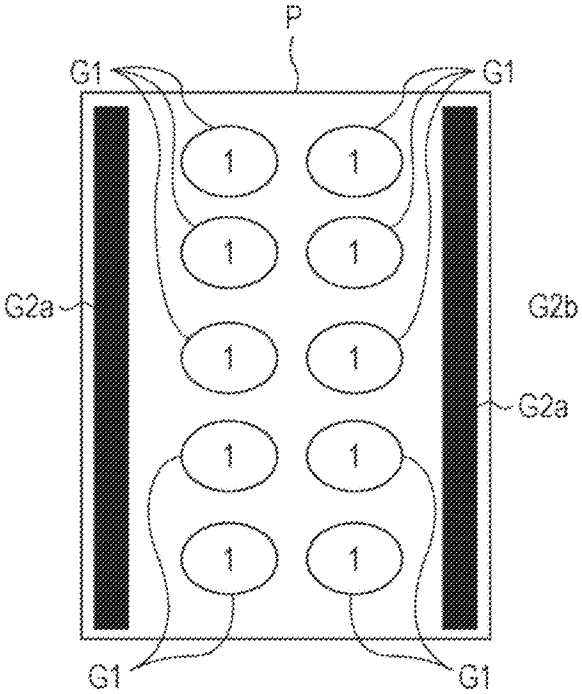
FIGS. 5A to 5C are diagrams illustrating an exemplary configuration of an image pattern for notifying a print position or the like of the image pattern for discharging the deteriorated toner.

FIG. 5A is a diagram for describing an exemplary notification in the case of notifying the user of the print position of the image pattern RFP. As illustrated in FIG. 5A, for example, in the case of executing continuous printing at a long printing distance (corresponding to the area Rb), in the case of executing test print, a plurality of normal images G1 for the test print is printed on an area other than the ends of the roll paper P, and an image pattern G2*a* for notifying the user of the print position of the image pattern RFP is printed on each of both ends of the roll paper P.

The image pattern G2*a* is of a belt-like shape (elongated rectangular shape) when viewed in a plan view. The longitudinal direction of the image pattern G2*a* extends along the longitudinal direction of the roll paper P. Additionally, the image pattern G2*a* is printed at substantially the same density as the density of the image pattern RFP and is printed at the same position as the position of the image pattern RFP. As a result, at the time of the test print, the user can grasp and confirm in advance the print position, shape, and the like of the image pattern RFP for discharging the deteriorated toner to be printed later.

Exemplary Configuration of Image Pattern G2*b*

Figure 5B:
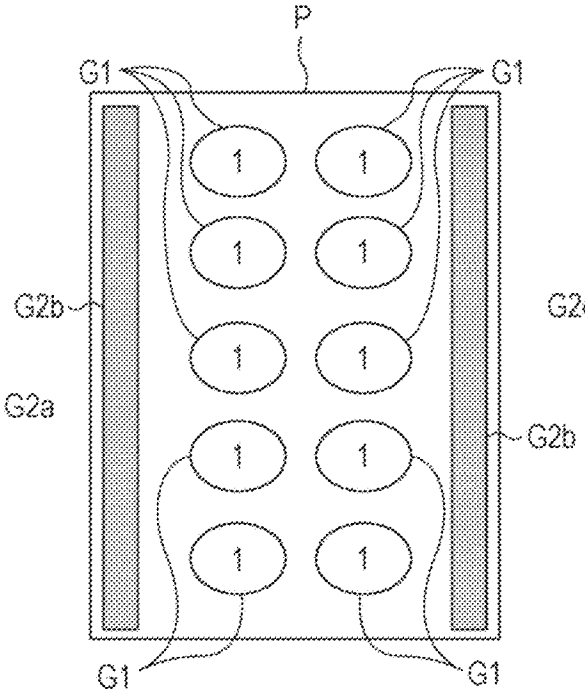

In addition to the image pattern G2*a* described above, other image patterns can be adopted. FIG. 5B is a diagram in a case where an image pattern G2*b* is adopted as another image pattern.

The image pattern G2*b* is of a belt-like shape (elongated rectangular shape) when viewed in a plan view. The longitudinal direction of the image pattern G2*b* extends along the longitudinal direction (extending direction) of the roil paper P. Additionally, the image pattern G2*b* is printed at a density lower than the density of the image pattern RFP and is printed at the same position as the position of the image pattern RFP. As a result, at the time of the test print, the user can grasp and confirm in advance the print position, shape, and the like of the image pattern RFP for discharging the deteriorated toner to be printed later while suppressing a toner consumption amount.

Exemplary Configuration of Image Pattern G2*c*

Figure 5C:
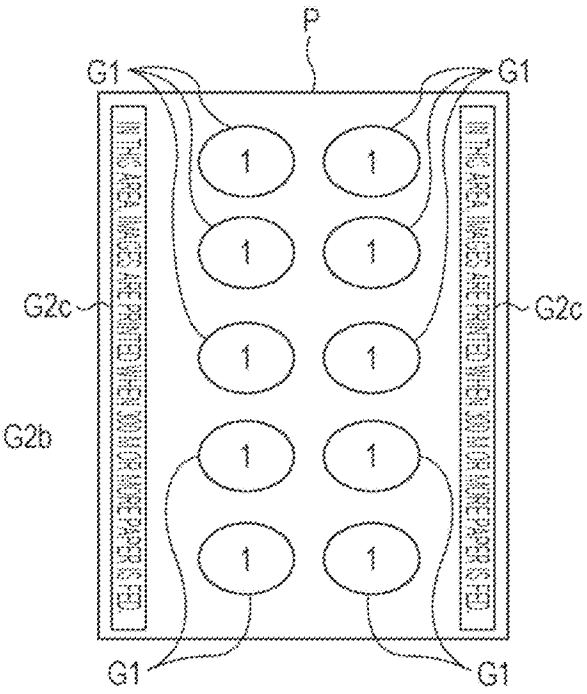

Furthermore, other patterns than the image patterns G2*a* and G2*b* described above may be adopted. FIG. 5C is a diagram in a case where an image pattern G2*c* is adopted as another image pattern.

The image pattern G2*c* includes a contour line printed so as to surround the area of the image pattern RFP having a belt-like shape and a caution message to be printed inside this contour line. As an example of the message sentence, "In this area, images are printed when paper 300 m or more is fed." is printed. A density of the image pattern G2*c* may be equal to or greater than the density of the image pattern RFP, or may be smaller than the density of the image pattern RFP. As a result, at the time of the test print, the user can grasp and confirm in advance the print position, shape, and the like of the image pattern RFP for discharging the deteriorated toner to be printed later.

Note that the position at which the image pattern G2 described above is printed is not limited to the ends of the roll paper P. For example, in a case where the image pattern RFP for discharging the deteriorated toner is printed in a gap between the normal images G1 and G1, the image pattern G2 for checking the print position of the image pattern RFP is also printed in the gap between the normal images G1 and G1 at the same position as the position of the image pattern RFP.

Exemplary Configuration of Image G2*d*

Additionally, in the above example, the print position of the image pattern REP is notified to the user by printing the image patterns G2*a*, G2*b*, and G2*c* on the roll paper P. However, the present embodiment is not limited to this example. For example, an image G2*d* indicating the print position of the image pattern RFP may be displayed on the screen of the operation display 360.

Figure 6:
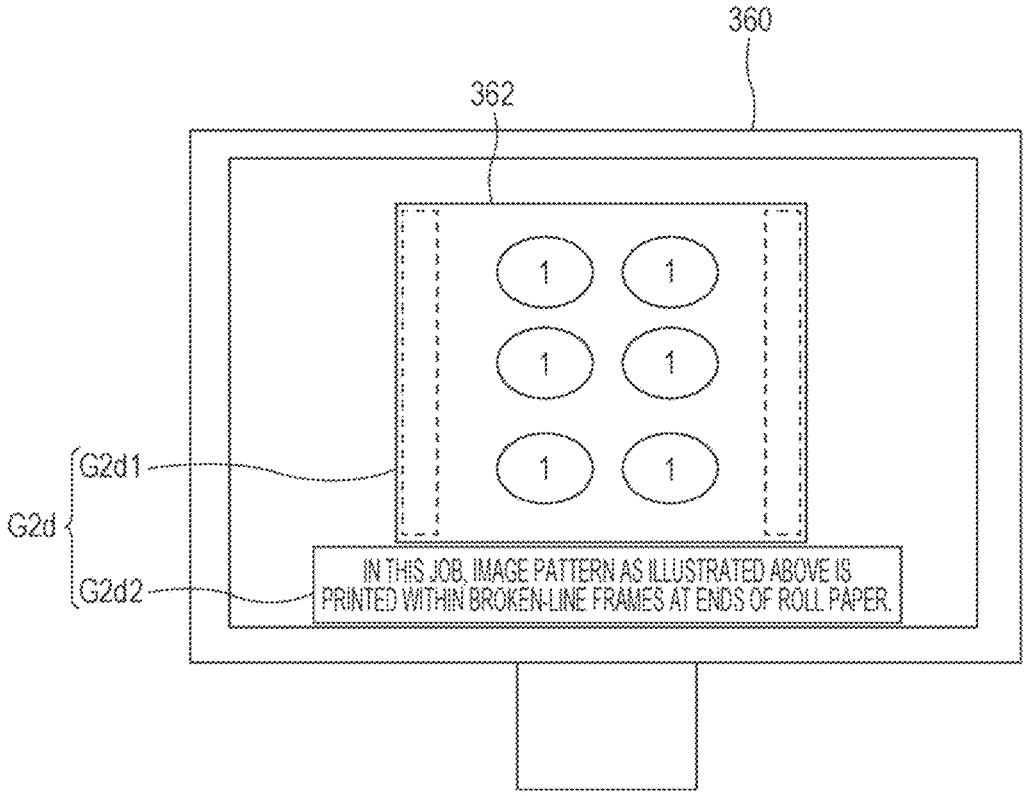
FIG. 6 is a diagram illustrating an exemplary configuration of an image for notifying the print position or the like of the image pattern for discharging the deteriorated toner.

FIG. 6 is a diagram for describing the image G2*d*. The image G2*d* includes, for example, an image G2*d* indicating the print position of the image pattern RFP and an image G2*d*2 including a message calling attention to the user. In the image G2*d*1, the print position of the image pattern RFP is illustrated by a broken line. As the image G2*d*2, for example, "In this job, an image pattern as illustrated above is printed within red broken-line frames at the ends of the roll paper" is displayed. As a result, the user can grasp and confirm the position, shape, and the like of the image pattern RFP for discharging the deteriorated toner before executing the job.

Exemplary Operation of Image Forming Apparatus 300

Figure 7:
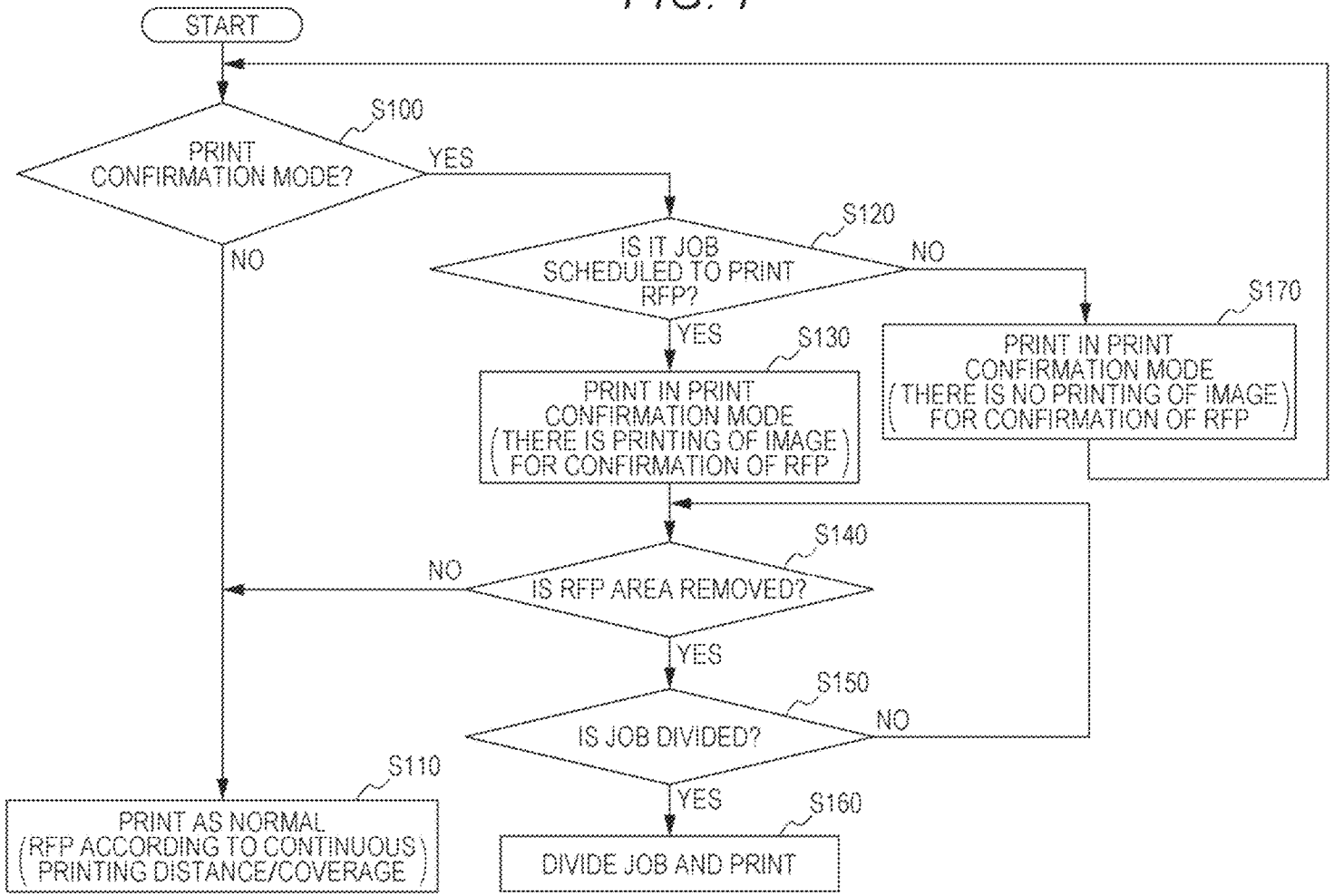

FIG. 7 is a flowchart illustrating an exemplary operation of the image forming apparatus 300 in a case where the print confirmation mode is executed. The CPU 352 of the image forming apparatus 300 achieves processes illustrated in the flowchart of FIG. 7 by executing the software read from the ROM 354.

In step S100, the controller 350 determines whether the print confirmation mode (test print mode) is set in the job to be executed. The print confirmation mode can be set by, for example, the operation display 360 or an operation unit such as a computer connected via a network. In a case where the controller 350 determines that the print confirmation mode is not set, the process proceeds to step S110.

In step S110, the controller 350 executes a normal printing process on the basis of a job transmitted from a computer or the like. For example, as illustrated in FIG. 3, in a case where the job corresponds to the area Rc, only the normal image G1 based on the job is printed on the roll paper P. At this time, the normal image G1 based on the job is printed on the entire area including the ends of the roll paper P on which the image pattern RFP described above is printed. Additionally, in a case where the area Rb is reached by executing the job, a switchover is configured so that the normal image G1 based on the job is printed on the substantially central area other than the ends of the roll paper P, and the image pattern RFP for discharging the deteriorated toner is printed on the area of the ends of the roll paper P.

Meanwhile, in a case where in step S100, the controller 350 determines that the print confirmation mode is set, the process proceeds to step S120.

In step S120, the controller 350 determines Whether the job is a job scheduled to print the image pattern RFP for discharging the deteriorated toner. For example, as illustrated in FIG. 3, it is determined, whether the job is a job having the continuous printing distance and the coverage information that correspond to the area Rb for printing the image pattern RFP for discharging the deteriorated toner. More specifically, it is determined whether the job corresponds to a case where the continuous printing distance is over 300 m and the image coverage is 3% or less. In a case where the controller 350 determines that the job is a job scheduled to print the image pattern RFP for discharging the deteriorated toner, the process proceeds to step S130.

in step S130, the controller 350 executes printing in the print confirmation mode. For example, before actual print is started, the controller 350 prints the image pattern G2*a* for confirmation and the like that are to inform the print position of the image pattern REP in advance (hereinafter, image patterns G2*a*, G2*b*, and G2*c* are collectively referred to as an image pattern G2) on the roll paper P together with the normal image G1 for test print. When the printing ends, the controller 350 stops the conveyance of the roll paper P at a position S (refer to FIG. 1) at which the image pattern G2 is discharged from a discharge port of the image forming apparatus 300. That is, the image pattern G2 printed on the roll paper P is stopped at a position at which the user can visually confirm the image pattern G2. Additionally, instead of these processes, it is also possible to display the image G2*d* for notifying the user of the print position of the image pattern RFP on the screen of the operation display 360 without printing the image pattern G2. When step S130 ends, the process proceeds to step S140.

In step S140, after printing the image pattern G2, the controller 350 determines whether to print the image pattern RFP, that is, whether to perform print control that eliminates a print area of the image pattern RFP and expands a normal image forming area. For example, the controller 350 displays a selection button for selecting whether or not to print the image pattern RFP on the screen of the operation display 360. The user can visually confirm the image pattern G2 that has actually been minted and the image G2*d* on the screen and judge whether or not to print the image pattern RFP, in a case where the controller 350 determines that a selection of printing the image pattern RFP is not input, the process proceeds to step S110 and executes the normal printing process as described above.

Meanwhile, in a case where the controller 350 determines in step S140 that a selection of not printing the image pattern RFP is input, the process proceeds to step S150.

In step S150, the controller 350 determines whether not dividing the job has been selected. For example, on the screen of the operation display 360, it is determined whether a button indicating to select dividing the job has been selected by the user. In a case where the controller 350 determines that a selection of dividing the job has been input by the user, the process proceeds to step S160.

In step S160, the controller 350 divides one job into two jobs and executes prating based on each of the divided jobs. As a result, the continuous printing distance of each job becomes shorter, for example, 300 m or less. Therefore, the job no longer corresponds to the area Rb illustrated in FIG. 3. After the printing of a previous job ends, the controller 350 executes a toner discharge process, and then executes the divided jobs. In the toner discharge process, the toner is transferred onto the intermediate transfer belt 324, and the toner transferred onto the intermediate transfer belt 324 is removed by the cleaning unit 328, thereby forcibly discharging the deteriorated toner in the developing device to the outside.

Meanwhile, in step S150, in a case where the controller 350 determines that the selection of dividing the job is not input by the user, the process returns to step S140 and the controller 350 waits for the presence or absence of an input of a selection as to whether to omit the image pattern RFP. Additionally, in this case, the process proceeds to step S110, and the normal printing process based on the job may be executed as described above.

Additionally, in step S120, in a case where the controller 350 determines that the job is not a job scheduled to print the image pattern RFP for discharging the deteriorated toner, the process proceeds to step S170. The above case is, for example, a case where the job corresponds to the area Rc as illustrated in FIG. 3, more specifically, a case where the continuous printing distance is less than 300 m.

In step S170, since the printing of the image pattern RFP for discharging the deteriorated toner is unnecessary, the controller 350 prints only the normal image G1 for test print on the roll paper P without printing the image pattern G2. When step S170 ends, the process proceeds to step S100, and then the normal printing based on the above-described job in step S110 is executed. In the present embodiment, such a printing operation is repeatedly executed.

Exemplary Operation In Case of Printing Image Pattern G2 According to Number of Print Copies Subsequently, even in a case where the above-described print confirmation mode is not set or in a case where there is no print confirmation mode, control may be performed so that the controller 350 automatically determines whether the printing is test print, and in a case where it is determined that the printing is test print, the image pattern G2 for notifying the user of the print position of the image pattern RFP may be printed on the roll paper P in advance. In the present embodiment, in a case where the number of print copies is one, it is possible to judge whether the printing is a test print depending on whether the continuous printing distance is long, or the continuous printing distance is short.

FIG. 8 illustrates an example of relationship between the continuous printing distance, the number of print copies, and the presence or absence of printing of the image pattern G2 for confirming the print position of the image pattern RFP. Note that in FIG. 8, "○" represents a case where the image pattern G2 for confirming the print position of the image pattern RFP is printed, "◎" represents a case where the image pattern RFP is printed, and "-" represents a case where neither the image pattern G2 nor the image pattern RFP is printed.

As illustrated in FIG. 8, in a case where the number of print copies is one and the continuous printing distance is 0 to 5 m that is short, it is judged that print is test print of a job corresponding to the area Rb illustrated in FIG. 3. In this case, the normal image G1 for test print is printed in the substantially central area other than the ends of the roll paper P, and the image pattern G2 for notifying the print position of the image pattern RFP is printed at both ends of the roll paper P.

Meanwhile, even in a case where the number of copies to be printed is a part, if the continuous printing distance is 5 to 300 m, it is not a test print but a print of a normal job corresponding to the area Rc illustrated in FIG. 3 to decide. In this case, the normal image G1 is printed on the entire area including the ends of the roll paper P, and the image pattern G2 for notifying the print position of the image pattern RFP is not printed. The normal image G1 is also printed in the area of the ends of the roll paper P on which the image pattern RFP is printed.

Additionally, in a case where the number of print copies is one and the continuous printing distance is 300 m or more that is long, it is judged that the printing is not test print, but print of the job that corresponds to the area Rb illustrated in FIG. 3 and that requires discharge of the toner. In this case, when the continuous printing distance is 300 m or less, the normal image G1 is printed on the entire area including the area of the ends of the roll paper P on which the image pattern RFP is printed. When the continuous printing distance exceeds 300 m, the normal image G1 based on the job is printed in the area other than the ends of the roll paper P, and the image pattern RFP for discharging the deteriorated toner is printed on each of both ends on the roll paper P.

Meanwhile, in a case where the number of print copies exceeds one and the continuous printing distance is 0 to 5 m or 5 to 300 m, it is determined that the printing, is print of a job that corresponds to the area Ra or the area Rc illustrated in FIG. 3 and does not involve test print. In this case, since any continuous printing distance is 300 m or less, only the normal image G1 is printed on the entire area including the end area on the roll paper P without printing the image pattern G2 and the image pattern RFP.

Meanwhile, when the number of print copies exceeds one and the continuous printing distance exceeds 300 m, it is determined that the printing is print of a job that corresponds to the area Rb illustrated in FIG. 3 and requires compulsory discharge of the toner. In this case, when the continuous printing distance is 300 m or less, the normal image G1 is printed on the entire area including the end area on the roll paper P. When the continuous printing distance exceeds 300 m, the normal image G1 based on the job is printed in the area other than the ends of the roil paper P, and the image pattern RFP for discharging the deteriorated toner is printed on each of both ends on the roll paper P.

As described above, according to the present embodiment, since the image pattern G2 for informing the print position of the image pattern RFP for discharging toner is actually printed on the roll paper P, the user can surely confirm the print position of the image pattern RFP. Additionally, the positional relationship between the image pattern REP and the normal image G1 based on the job can be confirmed beforehand, and it is possible to prevent the image pattern RFP and the normal image G1 from overlapping and printing.

Additionally, in the present embodiment, since the image pattern G2 is printed in the same area, the same pattern shape and the same density as the image pattern RFP, the image pattern RFP is confirmed in the same state as the actual image pattern RFP can do.

Additionally, according to the present embodiment, it is automatically determined whether the printing is test print from the continuous printing distance and the number of print copies. Therefore, even in a case where there is no setting such as the print confirmation mode, the image pattern G2 for confirming the print position can be printed on the roll paper P. As a result, the user can reliably confirm the print position of the image pattern RFP.

Additionally, according to the present embodiment, it is possible to select the presence or absence of printing of the image pattern RFP. Therefore, in a case where the print position of the image pattern G2 is already grasped, the printing of the image pattern RFP can be omitted, the amount of consumption can be reduced.

Additionally, according to the present embodiment, since the confirmation of the print position of the image pattern RFP is performed with the image G2*d* on the screen of the operation display 360, consumption of the toner and consumption of the continuous paper can be suppressed.

Furthermore, according to the present embodiment, it is possible to select not to print the image pattern RFP after confirming the print position of the image pattern RFP. As a result, in a case where not printing the image pattern RFP is selected, it is possible to suppress consumption of the toner can be suppressed, and it is possible to more widely use the image forming area, on which the normal image G1 based on the job can be printed. Furthermore, it is possible to reduce costs of the toner and the roll paper P.

Note that the technical scope of the embodiment of the present invention is not limited to the above-described embodiment, but includes various modifications to the above-described embodiment without departing from the spirit of the present invention. In the embodiment described above, the image pattern G2 for confirming the print position of the image pattern RFP is configured to be printed on the roll paper P a case where a predetermined condition is satisfied. However, the present embodiment is not limited to this configuration. For example, the image pattern G2 may be controlled to be typically printed, or the image pattern G2 is controlled not to be typically printed. These controls can be selected by dedicated buttons displayed on the screen of the operation display 360.

Additionally, in the case of jobs in the areas Ra and Rc in FIG. 3, the area for printing the normal image G1, is expanded to the entire area, including the ends for printing the image pattern RFP. However, the present embodiment is not limited to this configuration. For example, the ends of the roll paper P may be set as areas where the normal image G1 is not printed and dedicated areas where the image pattern RFP is printed.

Additionally, as illustrated in FIG. 1, there has been described an example in which the embodiment of the present invention is applied to the image forming apparatus 300 that forms a color image. However, the present embodiment is not limited to this example, and can be applied also to an image forming apparatus that forms a monochrome image.

Additionally, in the above-described embodiment, there has been described an example in which the controller 350 of the image forming apparatus 300 serves as a main controller, and performs the image forming process in conjunction with controllers provided in the paper feeding device 200 and the paper discharging device 400. However, the present embodiment is not limited to this example. For example, the controller provided in the paper feeding device 200 or the paper discharging device 400 may serve as a main controller, and perform the image forming process in conjunction with other controllers.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

an image former that develops, with toner, an electrostatic latent image formed on an image carrier on the basis of a job and prints a first image on continuous paper and;

a hardware processor that controls the image former to print a second image on continuous paper in a case where at least either image information or continuous printing distance information of the first image formed by the image former satisfies a predetermined condition, wherein the hardware processor notifies a user of print information indicating a print position of the second image formed by the image former.

2. The image forming apparatus according to claim 1, wherein the hardware processor controls the image former to print a third image as the print information in an area that is the same as an area of the second image.

3. The image forming apparatus according to claim 2, wherein the hardware processor controls the image former to print the third image on an end of continuous paper in a direction perpendicular to a conveying direction of the continuous paper.

4. The image forming apparatus according to claim 2, wherein the pattern of the third image is the same as the pattern of the second image.

5. The image forming apparatus according to claim 2, wherein a density of the third image is smaller than a density of the second image.

6. The image forming apparatus according to claim 2, wherein the third image is a character.

7. The image forming apparatus according to claim 2, wherein the hardware processor has a print confirmation mode for printing the third image on continuous paper, the third image is printed on the continuous paper in a case where the print confirmation mode is selected, and the continuous paper is stopped at a timing when the third image is discharged from a body of the image forming apparatus.

8. The image forming apparatus according to claim 2, wherein the hardware processor controls the image former to print the third image on continuous paper in a case where at least either a condition that the continuous printing distance is equal to or less than a predetermined distance or a condition that the number of print copies is equal to or less than a predetermined number of print copies.

9. The image forming apparatus according to claim 1, wherein the image forming apparatus is configured so that any of always printing, not printing, and printing the second image is selectable according to the condition.

10. The image forming apparatus according to claim 1, further comprising an operation display, wherein the hardware processor displays an image indicating a print position of the second image as the print information on a screen of the operation display.

11. The image forming apparatus according to claim 1, wherein the image forming apparatus configured to be selectable whether to divide the job after the print information is notified to the user.

* * * * *